US009121572B2

(12) United States Patent
Lewis et al.

(10) Patent No.: US 9,121,572 B2
(45) Date of Patent: Sep. 1, 2015

(54) LAMPSHADE AND FRAME ASSEMBLY

(71) Applicant: ONTEL PRODUCTS CORPORATION, Fairfield, NJ (US)

(72) Inventors: Joey Dean Lewis, San Clemente, CA (US); Chuck Khubani, Fairfield, NJ (US)

( * ) Notice: Subject to any disclaimer, the term of this patent is extended or adjusted under 35 U.S.C. 154(b) by 328 days.

(21) Appl. No.: 13/759,524

(22) Filed: Feb. 5, 2013

(65) Prior Publication Data

US 2013/0201695 A1 Aug. 8, 2013

Related U.S. Application Data

(60) Provisional application No. 61/595,592, filed on Feb. 6, 2012.

(51) Int. Cl.

| | |
|---|---|
| ***F21V 11/00*** | (2015.01) |
| ***F21V 1/02*** | (2006.01) |
| ***F21V 17/00*** | (2006.01) |
| *F21V 1/26* | (2006.01) |

(52) U.S. Cl.

CPC ..... *F21V 1/02* (2013.01); *F21V 17/002* (2013.01); *F21V 1/26* (2013.01); *Y10T 29/49876* (2015.01); *Y10T 29/49885* (2015.01)

(58) Field of Classification Search

CPC ..... F21V 17/002; F21V 1/02; F21V 1/26
USPC ..... 362/351, 352, 355, 361; 29/458, 453; 40/554

See application file for complete search history.

(56) References Cited

U.S. PATENT DOCUMENTS

| | | | | |
|---|---|---|---|---|
| 4,212,052 | A * | 7/1980 | Chambard | 362/352 |
| 5,662,412 | A * | 9/1997 | Glendmyer | 362/351 |
| 6,561,682 | B1 * | 5/2003 | Juang | 362/352 |
| 6,736,530 | B2 * | 5/2004 | Thevenot | 362/362 |
| 6,746,137 | B1 * | 6/2004 | Yeh | 362/352 |
| 6,821,002 | B1 * | 11/2004 | Morgen | 362/351 |
| 8,393,762 | B2 * | 3/2013 | Wu | 362/352 |
| 2002/0112386 | A1 * | 8/2002 | Thomas | 40/554 |
| 2002/0167812 | A1 * | 11/2002 | Strickland | 362/352 |
| 2004/0109320 | A1 * | 6/2004 | Sun | 362/352 |
| 2005/0007787 | A1 * | 1/2005 | Chou | 362/352 |
| 2005/0105292 | A1 * | 5/2005 | Hsu | 362/352 |
| 2005/0231960 | A1 * | 10/2005 | Li | 362/352 |
| 2008/0192487 | A1 * | 8/2008 | Giegerich et al. | 362/352 |
| 2009/0225553 | A1 * | 9/2009 | Wu | 362/351 |

* cited by examiner

*Primary Examiner* — Ali Alavi
(74) *Attorney, Agent, or Firm* — Epstein Drangel LLP; Robert L. Epstein

(57) ABSTRACT

A lampshade and frame assembly includes a rigid frame having an upper rigid ring parallel a lower rigid ring. A plurality of lateral support members interconnect the upper and lower rigid rings. A brace includes a substantially circular ring, and centrally fixes the ring between the support members near the upper rigid ring. A customizable cover includes a length of resilient opaque film formed as a continuous interchangeable band removably mountable to the frame. The cover has opposite ends joined together to form the band, and a top seam parallel to a bottom seam that define an open center portion for securing about the frame.

21 Claims, 4 Drawing Sheets

LAMPSHADE AND FRAME ASSEMBLY

CROSS-REFERENCE TO RELATED APPLICATION

This application claims the benefit of provisional patent application Ser. No. 61/595,592 filed in the United States Patent and Trademark Office on Feb. 6, 2012.

BACKGROUND OF THE INVENTION

1. Field of the Invention

This invention relates generally to lampshades and more particularly to a lampshade having a customizable cover, for coloring and drawing thereon, which is removably mounted to a frame support structure.

2. Description of the Related Art

Lampshades are in every room in every household. They offer a simple way for dressing-up a weathered room. Changing the color of a lampshade easily and inexpensively offers a room a refreshing new style. However, lampshades are expensive to purchase making them impracticable to interchange and replace. In addition, providing lampshades that are customizable and can be colored, drawn on or artistically improved are not only expensive but labor intensive to design and mount to a lamp.

While current customizable lampshades may be suitable for the particular purpose employed, or for general use, they would not be as suitable for the purposes of the present invention as disclosed hereafter.

It is, therefore, a primary object of the present invention to provide a lampshade having a customizable cover that is removably mounted to a frame assembly for displaying lampshade art.

It is, therefore, another object of the present invention to introduce a cover capable of providing an immediate and cost effective means for drawing and coloring your own customized art thereon.

It is, therefore, another object of the present invention to provide a lampshade assembly capable of being less labor intensive to assemble and less expensive to produce.

BRIEF SUMMARY OF THE INVENTION

In accordance with one aspect of the present invention, a lampshade assembly is introduced for securing a customizable shade to a lamp. The assembly comprises an opaque film cover and a frame support structure having a means on the frame for removably mounting the cover.

In accordance with an additional embodiment, a lampshade assembly is provided for use with a lamp having a harp. The assembly includes a rigid frame having an upper rigid ring parallel a lower rigid ring defining parallel planes and a distance there between. A plurality of lateral support members, having ends, are situated inside the plane and interconnect the upper and lower rigid rings. The assembly also includes a brace having a substantially circular ring for removably securing centrally between the support members preferably near the upper rigid ring. A circular collar attaches the lamp to the circular ring. The assembly also includes a cover having a length of resilient opaque film formed as a continuous interchangeable band removably mounted to the rigid frame.

Preferably, the cover of the lampshade assembly has a vertical length less than the distance between the upper and lower rigid rings.

The upper and lower rigid rings include distal sides having a lip for sandwiching the band of film there between.

A latch assembly is provided for removably coupling the brace to the lateral support members. The latch assembly includes a plurality of male protrusions extending outwardly from the brace, and a plurality of spring actuated female locking bases along the support members for accepting the male protrusions therein. The brace of the latch assembly adjustably connects to the support members for accommodating varying sized lamps.

The opaque film material of the cover is capable of accepting decorative designs created from pens, markers and paint.

The length of the cover includes opposite ends for securely overlapping to define the continuous band.

The band includes four corners, each having a circular opening. The upper and lower rigid rings include outwardly protruding buttons along a similar plane for securing the circular opening of the corners of the band thereto.

In alternate embodiments, the first and second ends of the cover are joined together by conventional adhesive.

Preferably, the circular ring of the brace is attached to the harp of the lamp by the collar.

The upper and lower rigid rings have equal diameters, or alternatively, the upper rigid ring has a smaller diameter than the lower rigid ring.

In accordance with an additional embodiment, a method of designing a customized lampshade assembly is introduced. The steps comprise first providing a rigid frame including an upper rigid ring parallel a lower rigid ring, a plurality of lateral support members interconnecting the upper and lower rigid rings, a collar including a substantially circular ring, and a plurality of elongated braces fixing the collar centrally between the support members near the upper rigid ring. Second a user draws, paints, writes and marks decorative designs about a length of resilient opaque film material. Third, a user removably mounts the length of resilient opaque film material as a continuous removable band between the rings of the rigid frame. The film has four corners and opposite ends joined together to form the band.

The fourth step includes overlapping the first and second ends of the band together and buttoning secure the corners of the band to the buttons of the rigid rings. Alternatively, the fifth step includes joining the first and second ends of the cover together by conventional adhesive.

In accordance with an additional embodiment, a method of assembling the customized lampshade disclosed supra includes first inserting the ends of the lateral support members within the upper and lower rigid rings. Next, inserting the male protrusions of the brace within the spring actuated female locking bases along the support members. Followed by wrapping the length of resilient opaque film of the cover around the rings between the upper and lower lips and then overlapping the ends of the film to define the continuous band. Finally, securing the ends of the band to the rings.

Additionally, the steps may further include positioning each latching assembly of the support members in a similar direction and aligning buttons of each ring within a common plane.

Furthermore, the method may include securing the corners of the band to the buttons of the rings.

BRIEF DESCRIPTION OF THE SEVERAL VIEWS OF THE DRAWINGS

To these and to such other objects that may hereinafter appear, the present invention relates to a lampshade and frame assembly as described in detail in the following specification and recited in the annexed claims, taken together with the accompanying drawings, in which like numerals refer to like parts in which:

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

DETAILED DESCRIPTION OF THE INVENTION

Figure 1:
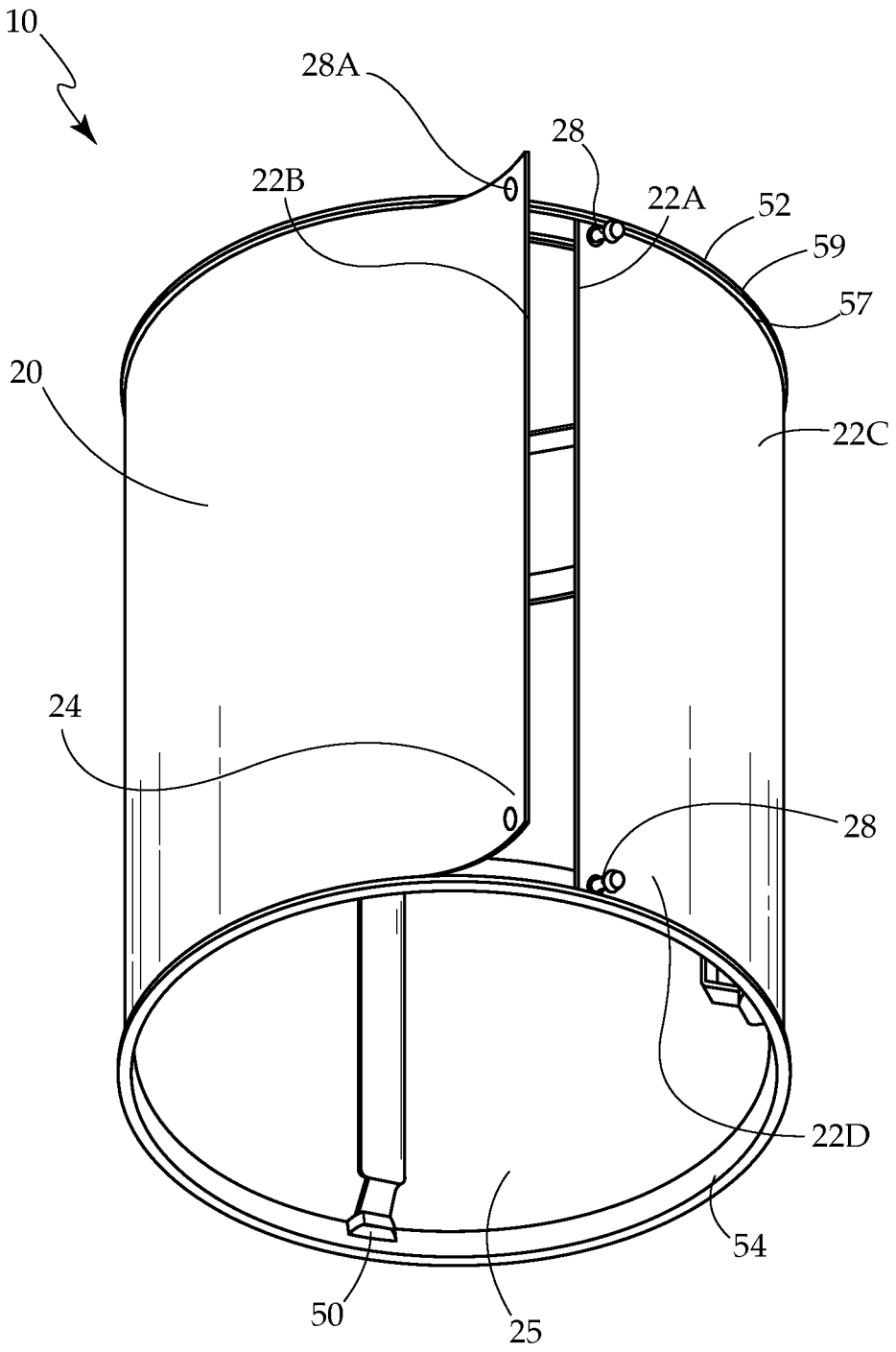
FIG. 1 is a schematic mounting view of a lampshade and frame assembly in accordance with the preferred embodiment of the present invention.

The present invention is directed to a lampshade and frame assembly 10, including in its broadest context a lampshade cover 20 and a rigid frame support structure 50 having a means for removably mounting the cover as shown in FIG. 1.

Figure 2:
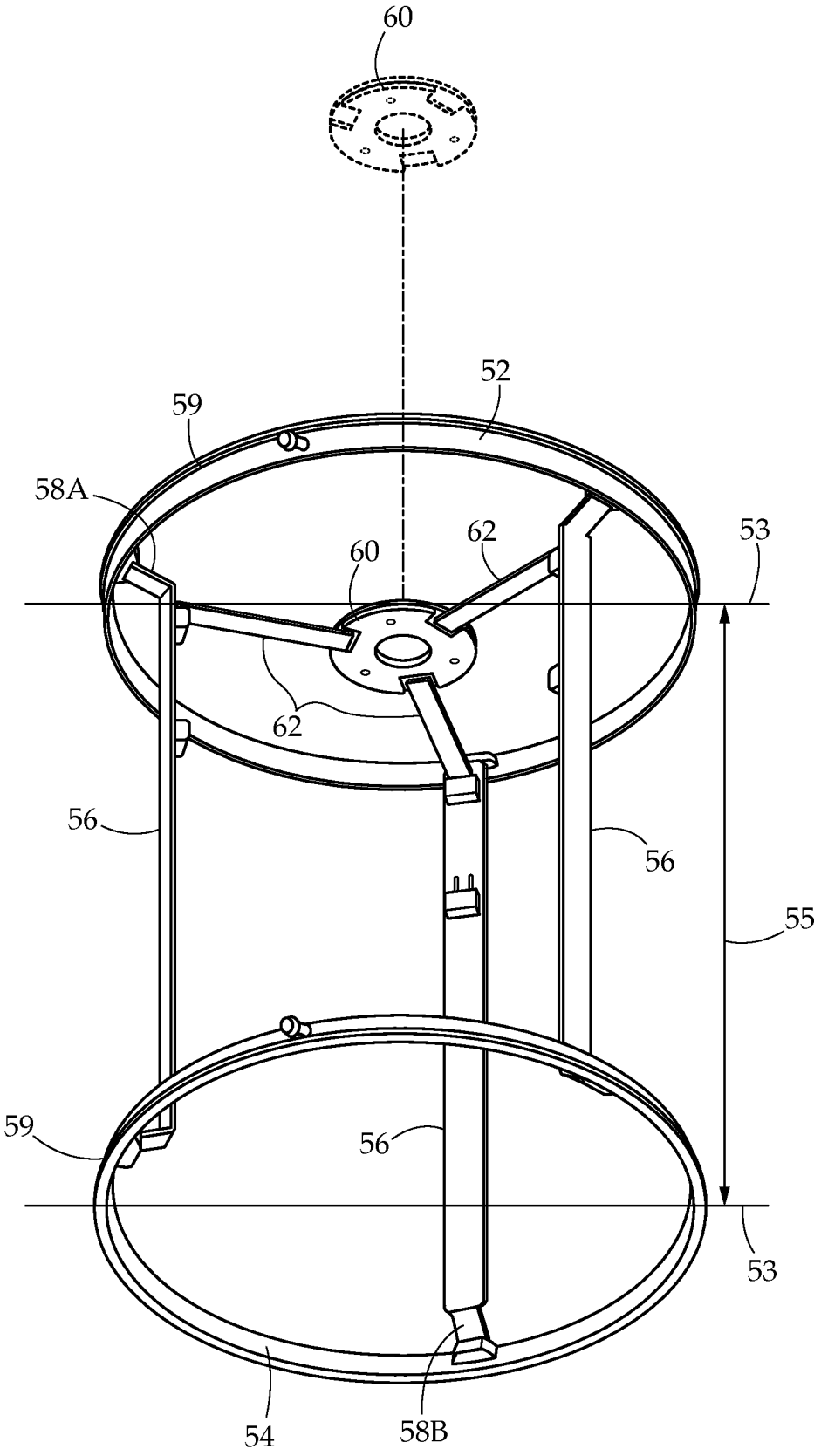
FIG. 2 is a bottom and side perspective view of a frame of the preferred embodiment of FIG. 1.

The frame 50, shown in FIG. 2, is formed of a number of separate parts that are coupled together to one another to form the assembled frame. More specifically, the frame 50 includes an upper rigid ring 52 and a lower rigid ring 54, and a plurality of lateral support members 56 that interconnect the upper and lower rings 52, 54. The support members 56 inserted between the rings 52, 54 provide rigidity to the frame 50 and provide a structure for securing the shade cover 20 thereabout. The upper and lower rigid rings 52, 54 each define a circumferential plane 53 and a distance 55 therebetween. The support members 56 have ends 56A situated inside the planes 53 of the upper and lower rings 52, 54. Preferably, each support member 56 is substantially U-shaped, such that they perpendicularly connect to each ring 52, 54 and then extend laterally there between. The upper and lower rigid rings 52, 54 each include a distal side 57 having a protruding lip 59 for securing the cover 20 about the rings 52, 54.

Figure 3:
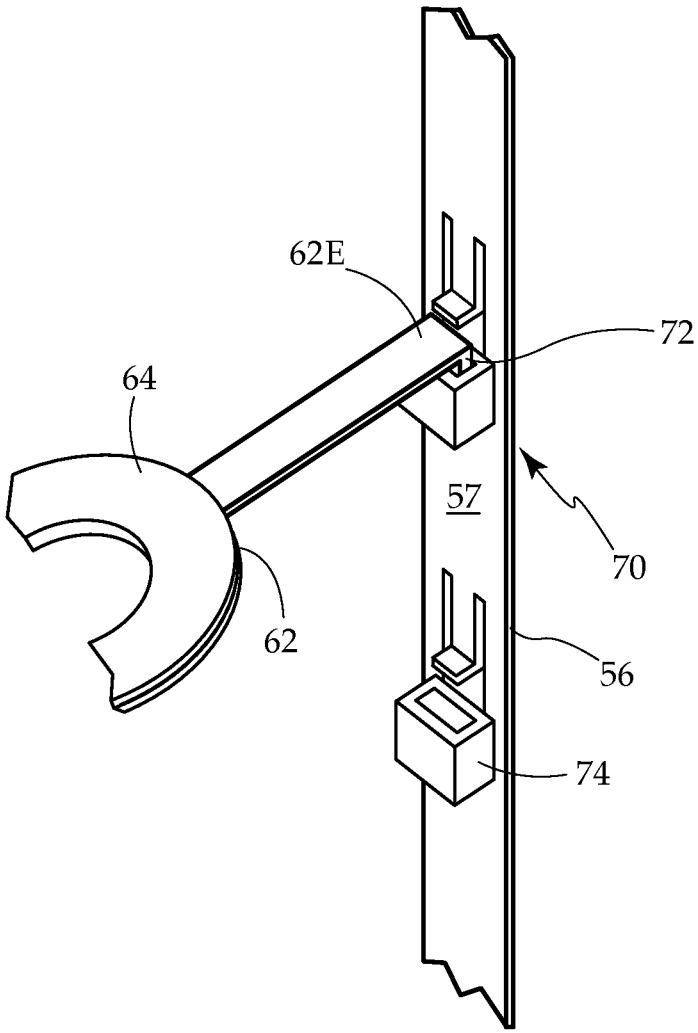
FIG. 3 is a top exploded partial view of a latch assembly of one supporting member that is part of the lampshade and frame assembly of FIG. 1.

The frame 50 includes an adjustable brace 60, having a substantially circular ring 62 centrally positioned between the lateral support members 56, near the upper rigid ring 52. The brace 60 is removably coupled and adjustable in position by perpendicularly connecting to the lateral support members 56, preferably by a latch assembly 70. As shown in FIG. 3, the ends 60E of the brace include male protrusions 72. The inner sides 57 of the support members 56 include a plurality of spring actuated female locking bases 74 for securely accepting the male protrusions 72 of the braces 60. A plurality of differently spaced latches are provided along the support members 57 such that the drop 82, distance from the top of the lampshade cover 20 to the center of the fitter, is variable for accommodating any size lamp and shade. The frame 50 includes a removable collar 64, preferably a substantially circular ring. The collar 64 attaches to the circular ring 62 of the brace 60 for adjustably attaching the assembly 10 to a lamp. Preferably, the collar 64 secures to the brace 60 by a plurality of holes therein for accepting protrusions along the circular ring 62 of the brace 60.

The lampshade cover 20 is preferably fabricated of a length of resilient opaque film for drawing and coloring customized images and designs thereon from pens, pencils markers and paint. In alternate embodiments, the film may be transparent or translucent for allowing light to pass there through and project color and designs onto surrounding objects. The cover 20 is formed as a continuous interchangeable band removably mounted to the rigid frame 50.

As illustrated in FIGS. 1-4, the band includes two ends 22 and top and bottom seams 22C, 22D. The ends 22 include a first end 22A and a second end 22B, which are joined by overlapping to form the band. Preferably, the band includes four corners 24, each having a circular opening 28A. The top seam 22C is parallel to the bottom seam 22D and each define an open center portion 25 for securing about the lamp. In particular, the cover 20 is connected about the support members 56 securely between the upper and lower rings 52, 54 by sandwiching the top and bottom sides 22C, 22D between the lips 59 of the upper and lower rings 52, 54. The upper and lower rings 52, 54 each include an outwardly protruding button 28 along a similar plane for securing the circular openings 28A of the corners 24 of the band thereto.

In alternate embodiments, the ends 22 are joined, overlapped or removably coupled together by conventional adhesive, sewn seem, hook and loop fastener, snaps, tape, latches, rivets or other like method for closure defining a generally tubular-shaped cover member depicted in FIG. 1.

Figure 4:
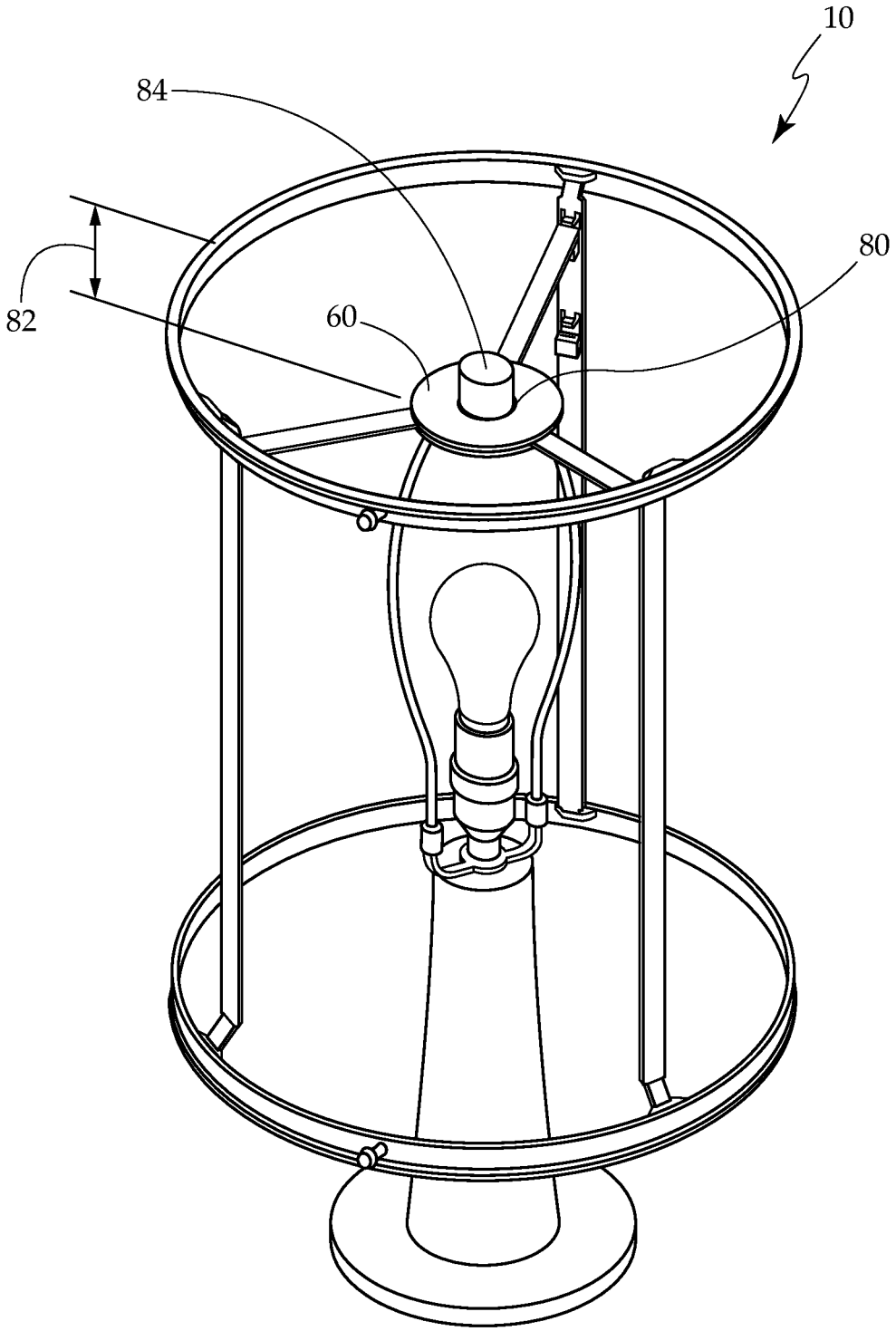
FIG. 4 is a diagrammatic top and front perspective view of the frame assembly of FIG. 1, in use coupled to a conventional lamp.

When in use, illustrated in FIG. 4, a removable cover 20 is securely coupled about the frame 50. The collar 64 is positioned about the harp 80 and connects thereto with a finial 84.

A user assembles the customized lampshade by positioning the latching assemblies of each support member in a similar direction and aligning the buttons of the rings within a common plane before inserting the ends of the lateral support members within the upper and lower rigid rings. Then, inserting the male protrusions of the brace within the corresponding spring actuated female locking bases along the support members. Next, the user wraps the length of resilient opaque film around the rings between the upper and lower lips and overlaps the ends of the film to define the continuous band. Finally, the user secures the corners of the band to the buttons of the rings.

In conclusion, herein is presented a lampshade having a customizable cover that is removably mounted to a frame assembly for displaying lampshade art. The invention is illustrated by example in the drawing figures, and throughout the written description. It should be understood that numerous variations are possible, while adhering to the inventive concept. Such variations are contemplated as being a part of the present invention. While only a limited number of preferred embodiments of the present invention have been disclosed for purposes of illustration, it is obvious that many modifications and variations could be made thereto. It is intended to cover all of those modifications and variations, which fall within the scope of the present invention as defined by the following claims.

We claim:

1. A lampshade assembly for use with a lamp having a harp, comprising:

a rigid frame including an upper rigid ring parallel a lower rigid ring defining parallel planes and a distance there between, a plurality of lateral support members having ends situated inside said plane and interconnecting said upper and lower rigid rings, a brace having a substantially circular ring for removably securing centrally between said support members near said upper rigid ring, and a circular collar for attaching said lamp to said circular ring; and a cover including a length of resilient opaque film formed as a continuous interchangeable band removably mounted to said rigid frame.

2. The lampshade assembly of claim 1, wherein said upper rigid ring has a smaller diameter than said lower rigid ring.

3. The lampshade assembly of claim 1, wherein said opaque film material of said cover is capable of accepting decorative designs created from pens, pencils, markers and paint.

4. The lampshade assembly of claim 1, wherein said cover has a vertical length less than said distance between said upper and lower rigid rings.

5. The lampshade assembly of claim 1, wherein said upper and lower rigid rings include distal sides having a lip for sandwiching said band of film there between.

6. The lampshade assembly of claim 1, further comprising a latch assembly means for removably coupling said brace to said lateral support members.

7. The lampshade assembly of claim 6, wherein said latch assembly means includes a plurality of male protrusions extending outwardly from said brace, and a plurality of spring actuated female locking bases along said support members for accepting said male protrusions therein.

8. The lampshade assembly of claim 7, wherein said brace of said latch assembly adjustably connects to the support members for accommodating lamps having varying drops.

9. The lampshade assembly of claim 1, wherein said length of said cover includes opposite ends for securely overlapping to define said continuous band.

10. The lampshade assembly of claim 9, wherein said band included four corners, each said corner having a circular opening.

11. The lampshade assembly of claim 10, wherein said upper and lower rigid rings include outwardly protruding buttons along a similar plane for securing said circular opening of said corners of said band thereto.

12. The lampshade assembly of claim 11, wherein the first and second ends of said cover are joined together by conventional adhesive.

13. The lampshade assembly of claim 1, wherein said circular ring of said brace is attached to said harp of said lamp by said collar.

14. The lampshade assembly of claim 1, wherein said upper and lower rigid rings have equal diameters.

15. A method of designing a customized lampshade assembly, the steps comprising:

(a) providing a rigid frame including an upper rigid ring parallel a lower rigid ring, a plurality of lateral support members interconnecting said upper and lower rigid rings, a collar including a substantially circular ring, a plurality of elongated braces fixing said collar centrally between said support members near said upper rigid ring;

(b) drawing, painting, writing and marking decorative designs about a length of resilient opaque film material; and (c) removably mounting said length of resilient opaque film material as a continuous removable band between said rings of said rigid frame, having four corners and opposite ends joined together to form said band.

16. The method of designing a customized lampshade assembly of claim 15, wherein the steps comprise overlapping the first and second ends of the band together and buttoning secure the corners of the band to the buttons of the rigid rings.

17. The method of designing a customized lampshade assembly of claim 16, wherein the steps comprise joining the first and second ends of the cover together by conventional adhesive.

18. A method of assembling a customized lampshade assembly for use with a lamp having a harp, a rigid frame including an upper rigid ring parallel a lower rigid ring defining parallel planes and a distance there between, a plurality of lateral support members having ends situated inside said plane and interconnecting said upper and lower rigid rings, a brace having a substantially circular ring for removably securing centrally between said support members near said upper rigid ring, and a circular collar for attaching said lamp to said circular ring; and a cover including a length of resilient opaque film formed as a continuous interchangeable band removably mounted to said rigid frame the customized lampshade, wherein the steps comprise:

(a) inserting the ends of the lateral support members within the upper and lower rigid rings;

(b) inserting the male protrusions of the brace within the spring actuated female locking bases along the support members;

(c) wrapping the length of resilient opaque film of the cover around the rings between the upper and lower lips;

(d) overlapping the ends of the film to define the continuous band; and (e) securing the ends of the band to the rings.

19. The method of assembling the customized lampshade of claim 18, wherein step (a) further comprise positioning each latching assembly of the support members in a similar direction.

20. The method of assembling the customized lampshade of claim 18, wherein step (a) further comprises aligning buttons of each rings within a common plane.

21. The method of assembling the customized lampshade of claim 20, wherein step (e) further comprises securing corners of the band to said buttons of the rings.

* * * * *